US007865998B2

(12) United States Patent
Ahn

(10) Patent No.: US 7,865,998 B2
(45) Date of Patent: Jan. 11, 2011

(54) BEARING HOUSING, AND MOTOR ASSEMBLY AND VACUUM CLEANER HAVING THE SAME

(75) Inventor: Kwang-Woon Ahn, Seoul (KR)

(73) Assignee: LG Electronics Inc., Seoul (KR)

( * ) Notice: Subject to any disclaimer, the term of this patent is extended or adjusted under 35 U.S.C. 154(b) by 1049 days.

(21) Appl. No.: 11/616,439

(22) Filed: Dec. 27, 2006

(65) Prior Publication Data

US 2008/0050252 A1 Feb. 28, 2008

(30) Foreign Application Priority Data

Aug. 25, 2006 (KR) ..... 10-2006-0081335

(51) Int. Cl.
*A47L 9/12* (2006.01)

(52) U.S. Cl. ..... 15/412

(58) Field of Classification Search 15/412; *A47L 9/12*
See application file for complete search history.

(56) References Cited

U.S. PATENT DOCUMENTS 2,175,641 A * 10/1939 Replogle ..... 417/247
5,027,469 A * 7/1991 Toyoshima et al. ..... 15/339
5,632,578 A * 5/1997 McCurry et al. ..... 409/136

* cited by examiner

*Primary Examiner*—David A Redding
(74) *Attorney, Agent, or Firm*—KED & Associates, LLP

(57) ABSTRACT

Disclosed are a bearing housing, and a motor assembly and a vacuum cleaner having the same. The motor assembly includes: a motor housing; a motor installed in the motor housing, for supplying suction force; an impeller rotatably installed on a rotation shaft of the motor; an impeller cover coupled to the motor housing, for covering the impeller; a guide vane installed between the motor and the impeller, and composed of a plurality of diffuser vanes for converting some of dynamic pressure of the air passing through the impeller into static pressure, and a plurality of return vanes formed on the bottom surfaces of the diffuser vanes, for forming passages for guiding the air with its pressure raised by the diffuser vanes to the motor side; and a bearing housing including a passage formation unit for forming passages by contacting the bottom ends of the return vanes, and a shaft support unit for supporting the rotation shaft of the motor. The motor assembly and the vacuum cleaner having the same solve incomplete passage formation of the return vanes due to miniaturization of the fan-motor, and provide the passages with an optimum area.

3 Claims, 8 Drawing Sheets

BEARING HOUSING, AND MOTOR ASSEMBLY AND VACUUM CLEANER HAVING THE SAME

RELATED APPLICATION

The present disclosure relates to subject mater contained in priority Korean Application No. 10-2006-0081335, filed on Aug. 25, 2006, which is herein expressly incorporated by reference in its entirety.

BACKGROUND OF THE INVENTION

1. Field of the Invention

The present invention relates to a vacuum cleaner, and more particularly, to a bearing housing capable of forming passages even in a miniaturized vacuum cleaner, and a motor assembly and a vacuum cleaner having the same.

2. Description of the Background Art

FIG. 1 is a vertical-sectional view illustrating a fan-motor structure for a conventional vacuum cleaner. Referring to FIG. 1, in the fan-motor for the conventional vacuum cleaner, a motor 4 composed of a stator 2 and a rotor 3 is installed in a motor receiving portion 1*a* of a motor housing 1 having its upper portion opened, and a rotation shaft 5 fit-pressed into the center portion of the rotor 3 in the up/down direction and rotated with the rotor 3 for transferring power is coupled to the rotor 3.

An opening unit of an impeller cover 6 having a suction hole 6*a* on its top surface is coupled to the upper opening unit of the motor housing 1. An impeller 7 coupled to the top end of the rotation shaft 5, for raising dynamic pressure of the air sucked through the suction hole 6*a* is installed inside the impeller cover 6. A guide vane 8 for guiding the air sucked into the impeller cover 6 by the impeller 7 to the motor 4 is installed at the lower portion of the impeller 7. In detail, the guide vane 8 is installed in a guide vane receiving portion 1*b* of the motor housing 1.

The guide vane 8 includes a plurality of diffuser vanes 8*a* for converting some of the dynamic pressure of the air passing through the impeller 7 into static pressure, and a plurality of return vanes 8*b* formed on the bottom surfaces of the diffuser vanes 8*a*, for forming passages for guiding the air with its pressure raised by the diffuser vanes 8*a* to the motor 4.

A bearing housing 10 is installed between the motor 4 and the return vanes 8*b* of the guide vane 8.

As illustrated in FIGS. 2 to 4, the center portion of the bearing housing 10 supports the rotation shaft 5, and the edges thereof are fixed to the motor housing 1. The motor housing 1 includes the motor receiving portion 1*a* in which the motor 4 is installed, the guide vane receiving portion 1*b* in which the guide vane 8 is installed, and a step portion 1*c* for connecting the motor receiving portion 1*a* to the guide vane receiving portion 1*b*.

The bearing housing 10 will now be explained in detail. The bearing housing 10 includes a support protrusion 10*a* being protruded from the center portion in a cylindrical shape, and having a shaft hole 10*a*' for housing the rotation shaft 5, connection units 10*c* extended from the support protrusion 10*a* to both directions, and fixing units 10*b* incorporated with the connection units 10*c* and fixed to the motor housing 1.

Preferably, the fixing units 10*b* have a lager cross section area than the connection units 10*c*. The edges of the fixing units 10 are formed in a circular arc shape to be equivalent to the inner surface of the motor housing 1. A plurality of fastening holes 10*d* for coupling the bearing housing 10 to the motor housing 1 are formed on the fixing units 10*b*.

As shown in FIG. 5, a bearing (not shown) for rotatably supporting the rotation shaft 5 is generally mounted on the inner surface of the support protrusion 10*a*. The outer surface of the support protrusion 10*a* is inserted into a hole formed in the return vane side 8*b* of the guide vane 8.

In order for the fan-motor for the vacuum cleaner to obtain high suction force, the diffuser vanes 8*a* and the return vanes 8*b* must have a static pressure restoration function. Thus, channel type passages are necessary.

For this, the diffuser vanes 8*a* are coupled to the impeller cover 6 (refer to FIG. 1), for forming passages, and the return vanes 8*b* are coupled to the motor housing 1 (refer to FIG. 1), for forming passages.

The bearing housing 10 is formed in an almost straight shape with the rigidity for supporting the rotation shaft 5 and the bearing (not shown).

However, with the miniaturization or high speed tendency of the fan-motor for the vacuum cleaner, the fan side outside diameter (namely, the inside diameter of 1*b*) of fan is rarely different from the stator side outside diameter (namely, the inside diameter of 1*a*) of the stator 2.

Therefore, the lower portions of the return vanes 8*b* formed on the bottom end of the guide vane 8 are almost opened. The air flowing to the return vanes 8*b* does not pass through the channel type passages of the return vanes 8*b*, but flows to the stator side 2 of the fan-motor. As a result, the guide vane 8 cannot raise the static pressure.

In the conventional fan-motor using the bearing housing 10, when the return vanes 8*b* are coupled to the motor housing 1, the bottom ends of the return vanes 8*b* are not blocked but opened. Thus, high suction force is not obtained.

SUMMARY OF THE INVENTION

Therefore, an object of the present invention is to provide a motor assembly having a bearing housing capable of obtaining high suction force in a miniaturized fan-motor by forming channel type passages of return vanes with an optimum area, and a vacuum cleaner having the same.

To achieve these and other advantages and in accordance with the purpose of the present invention, as embodied and broadly described herein, there is provided a motor assembly, including: a motor housing; a motor installed in the motor housing, for supplying suction force, an impeller rotatably installed on a rotation shaft of the motor; an impeller cover coupled to the motor housing, for covering the impeller; a guide vane installed between the motor and the impeller, and composed of a plurality of diffuser vanes for converting some of dynamic pressure of the air passing through the impeller into static pressure, and a plurality of return vanes formed on the bottom surfaces of the diffuser vanes, for forming passages for guiding the air with its pressure raised by the diffuser vanes to the motor side; and a bearing housing including a passage formation unit for forming passages by contacting the bottom ends of the return vanes, and a shaft support unit for supporting the rotation shaft of the motor.

Since the bearing housing additionally includes the passage formation unit, the channel type passages of the return vanes can be formed in a miniaturized fan-motor for a small-sized vacuum cleaner, to obtain high suction force and improve efficiency of the vacuum cleaner.

Preferably, the shaft support unit and the passage formation unit are formed as a single body, to improve productivity of the bearing housing and efficiently cope with miniaturization of the fan-motor.

Preferably, the shaft support unit includes: a support protrusion having a shaft hole for housing the rotation shaft of the motor; and connection plates having one-side ends extended from the support protrusion and the other-side ends incorporated with the passage formation unit and fixed to the motor housing.

This configuration prevents the shaft support unit from being twisted due to a twisting moment of the shaft hole or the support protrusion by rotation of the rotation shaft.

The shaft support unit further includes support plates extended from the connection plates.

The passage formation unit is formed in a ring or loop shape with a predetermined cross section area. Therefore, the area of the passages formed by the passage formation unit and the return vanes of the guide vane can be maintained constant.

The outside diameter of the passage formation unit contacts the inner surface of the motor housing, and the inside diameter of the passage formation unit reaches 60 to 82.5% of the outside diameter, to improve efficiency of the fan-motor.

The shaft support unit can have a height difference from the passage formation unit. That is, since the passage formation unit is disposed at the lower portions of the connection plates of the shaft support unit, the outside diameter of the passage formation unit can be inserted into the inside diameter of the motor housing. The bearing housing can be easily applied to the miniaturized fan-motor.

The passage formation unit contacts the outer portions of the bottom ends of the return vanes. If the passage formation unit contacts the whole bottom ends of the return vanes, the passages are wholly blocked not to discharge the sucked air to the rear direction of the motor.

There is also provided a vacuum cleaner, including a cleaner main body, a suction hose connected to the front portion of the cleaner main body, a handle formed at the end of the suction hose, an extension tube having its one end connected to the handle, a suction nozzle body detachably connected to the other end of the extension tube, for sucking the outdoor air and dust along the bottom, and a motor assembly installed in the cleaner main body, for generating suction force, wherein the motor assembly includes: a motor housing; a motor installed in the motor housing, for supplying suction force; an impeller rotatably installed on a rotation shaft of the motor; an impeller cover coupled to the motor housing, for covering the impeller; a guide vane installed between the motor and the impeller, and composed of a plurality of diffuser vanes and a plurality of return vanes formed on the bottom surfaces of the diffuser vanes; and a bearing housing including a passage formation unit for forming passages by contacting the bottom ends of the return vanes, and a shaft support unit for supporting the rotation shaft of the motor.

Preferably, the ratio of the inside diameter to the outside diameter of the passage formation unit ranges from 0.6 to 0.82, and the shaft support unit is incorporated with the passage formation unit.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE INVENTION

Reference will now be made in detail to the preferred embodiments of the present invention, examples of which are illustrated in the accompanying drawings.

Figure 1:
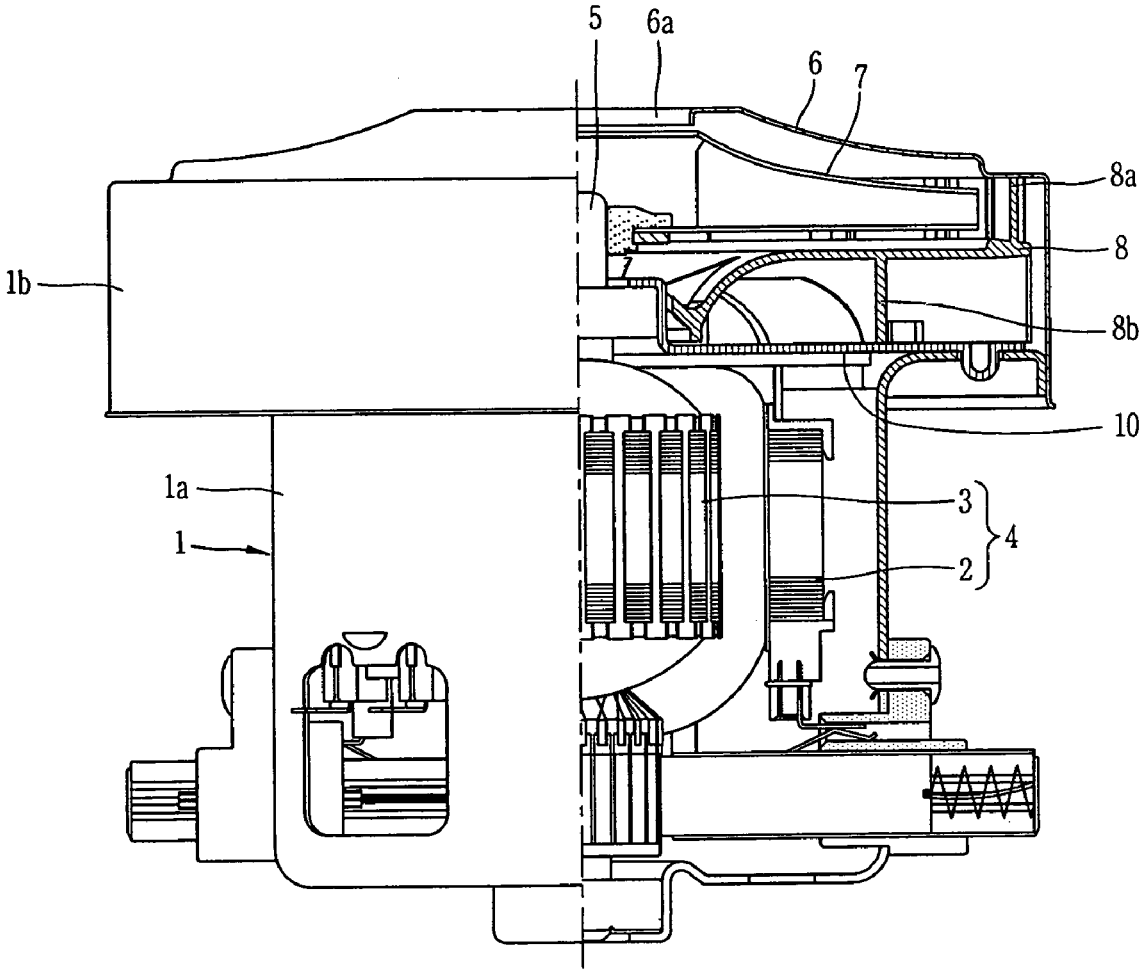
FIG. 1 CONVENTIONAL ART
FIG. 1 is a vertical-sectional view illustrating a fan-motor for a conventional vacuum cleaner.
Figure 2:
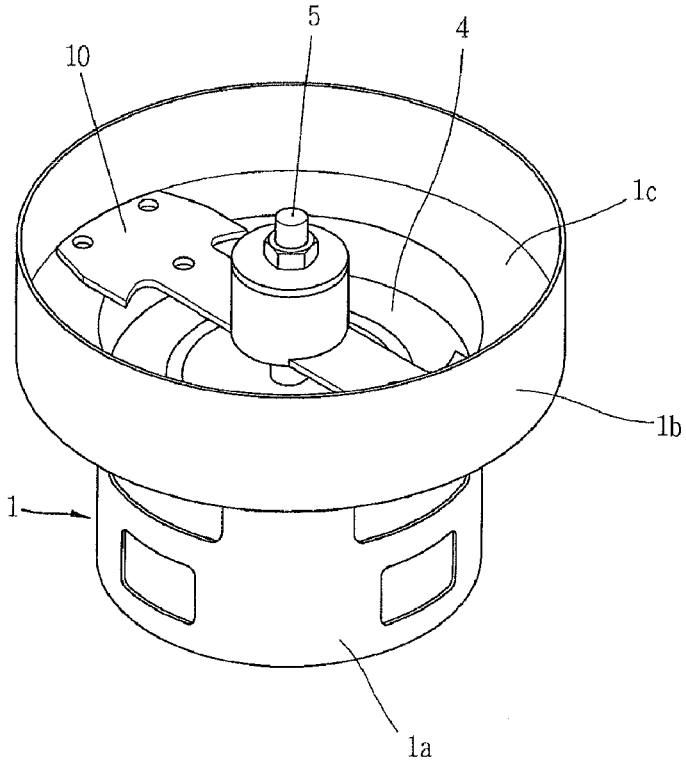
FIG. 2 CONVENTIONAL ART
FIG. 2 is a perspective view illustrating a coupling state of a bearing housing and a rotation shaft of a motor in FIG. 1.
Figure 3:
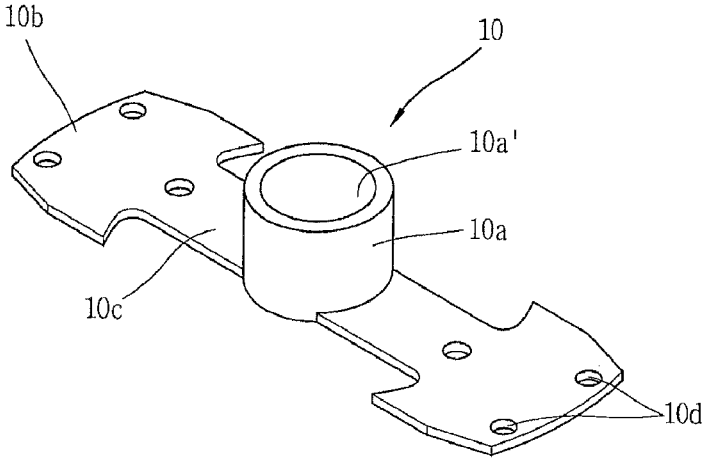
FIG. 3 CONVENTIONAL ART
FIG. 3 is a perspective view illustrating the bearing housing of FIG. 2.
Figure 4:
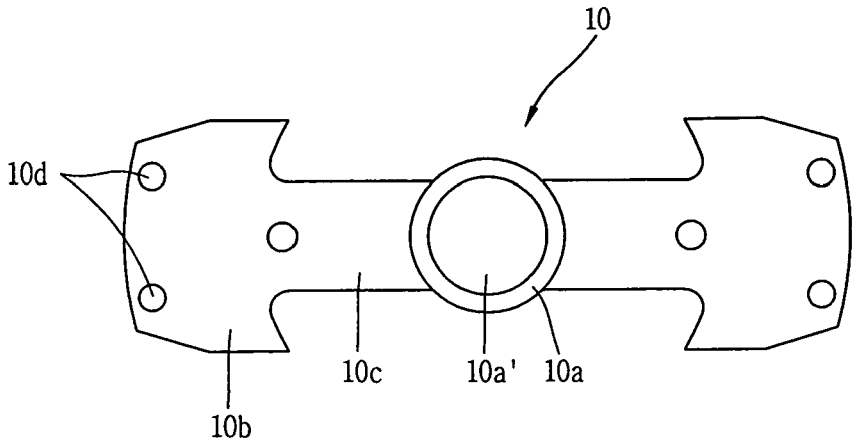
FIG. 4 CONVENTIONAL ART
FIG. 4 is a plane view illustrating the bearing housing of FIG. 2.
Figure 5:
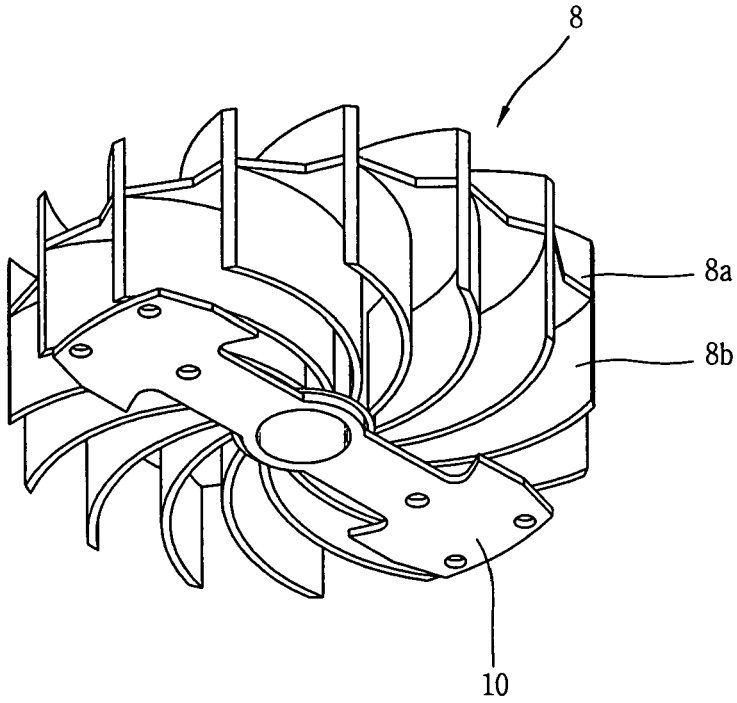
FIG. 5 CONVENTIONAL ART
FIG. 5 is a perspective view illustrating a coupling state of the bearing housing and a guide vane in FIG. 1.
Figure 6:
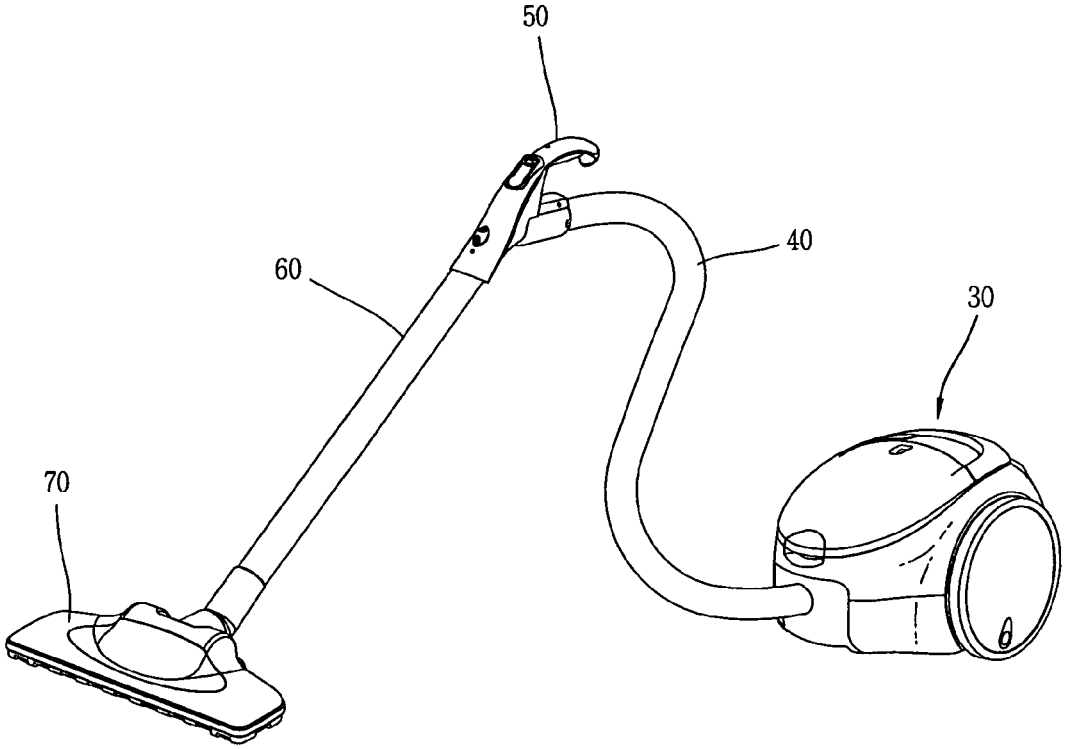
FIG. 6 is a perspective view illustrating a vacuum cleaner having a motor assembly in accordance with the present invention.
Figure 7:
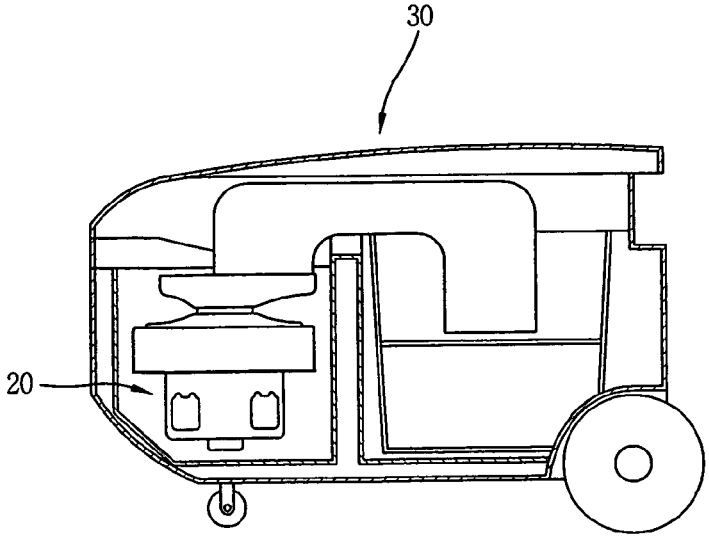
FIG. 7 is a cross-sectional view illustrating a vacuum cleaner main body of FIG. 6.
Figure 8:
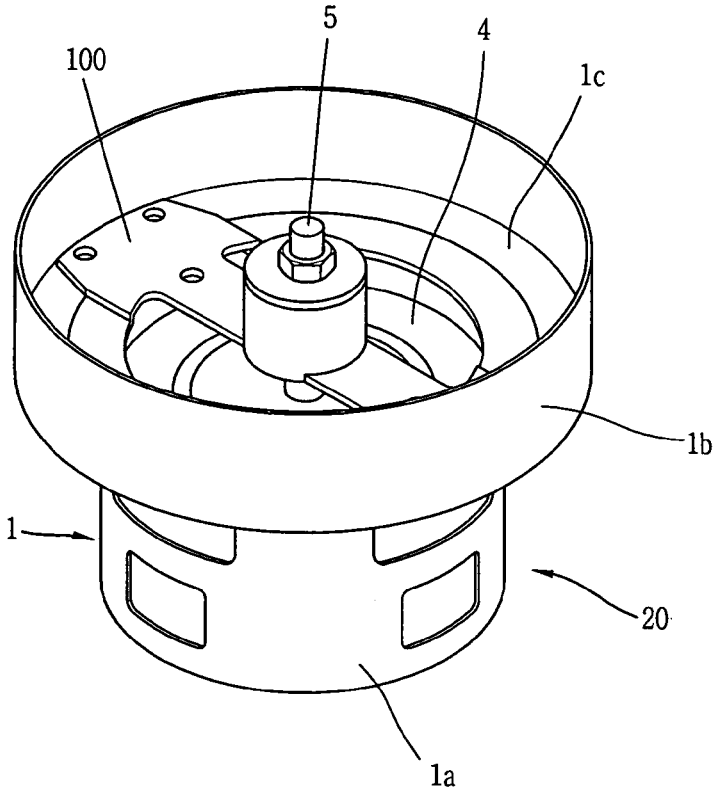
FIG. 8 is a perspective view illustrating a coupling state of a bearing housing and a rotation shaft of a motor in FIG. 6.
Figure 9:
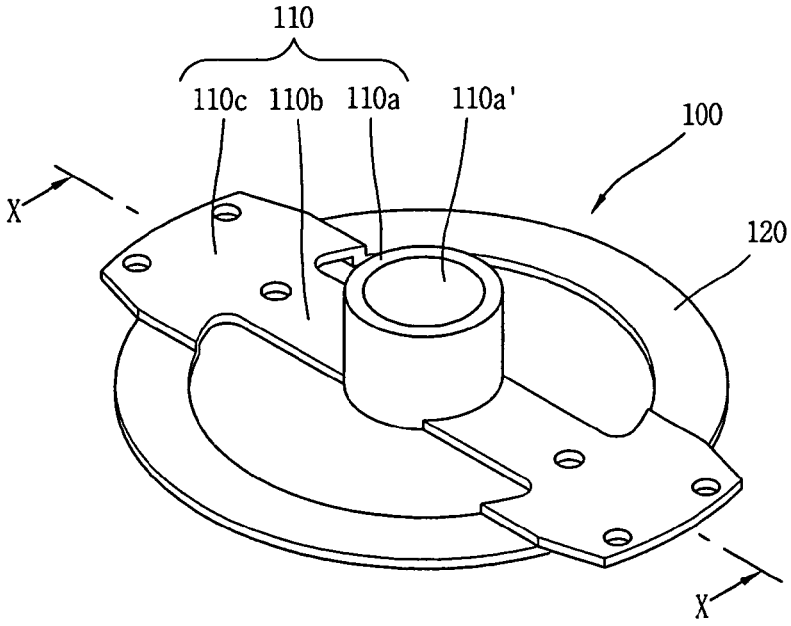
FIG. 9 is a perspective view illustrating the bearing housing of FIG. 8.
Figure 10:
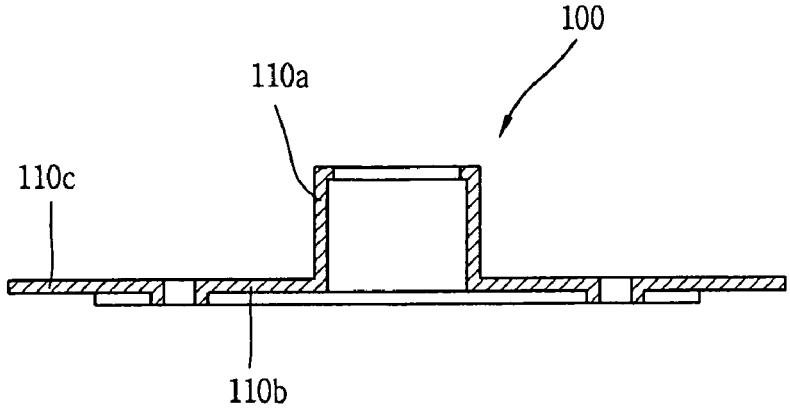
FIG. 10 is a cross-sectional view taken along line X-X of FIG. 9.
Figure 11:
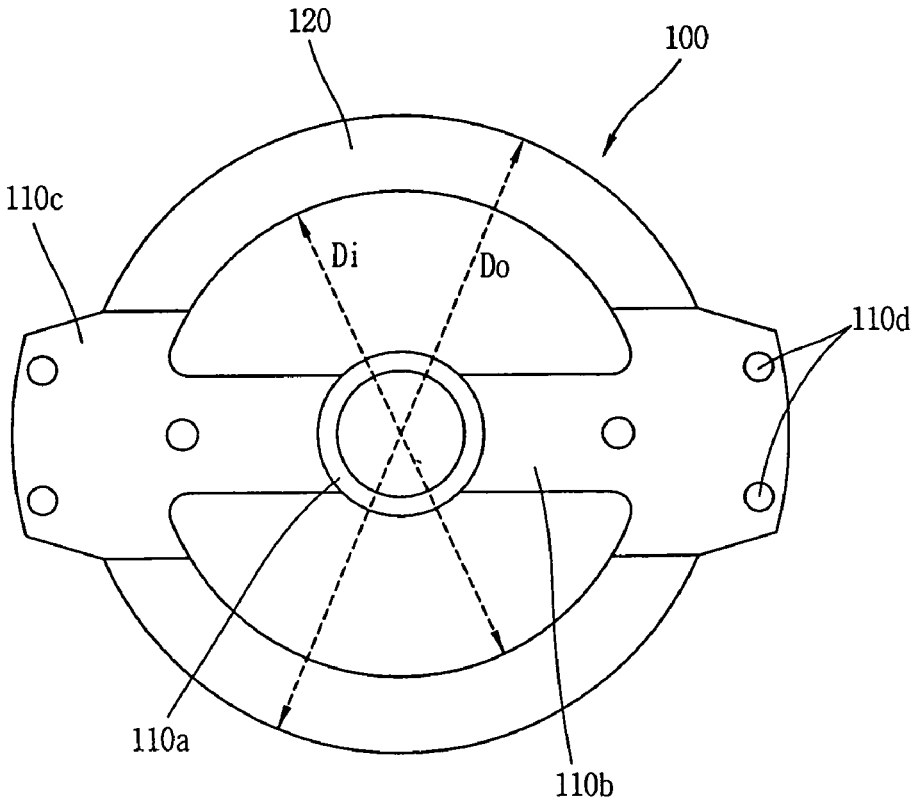
FIG. 11 is a plane view illustrating the bearing housing of FIG. 8.
Figure 12:
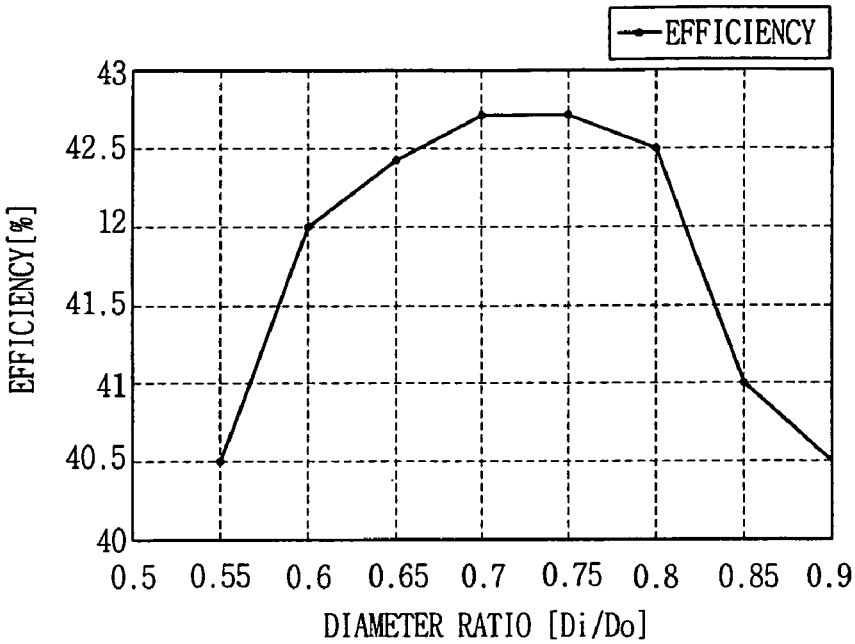
FIG. 12 is a graph illustrating experiment data showing efficiency by a diameter ratio of the bearing housing of FIG. 11.
Figure 13:
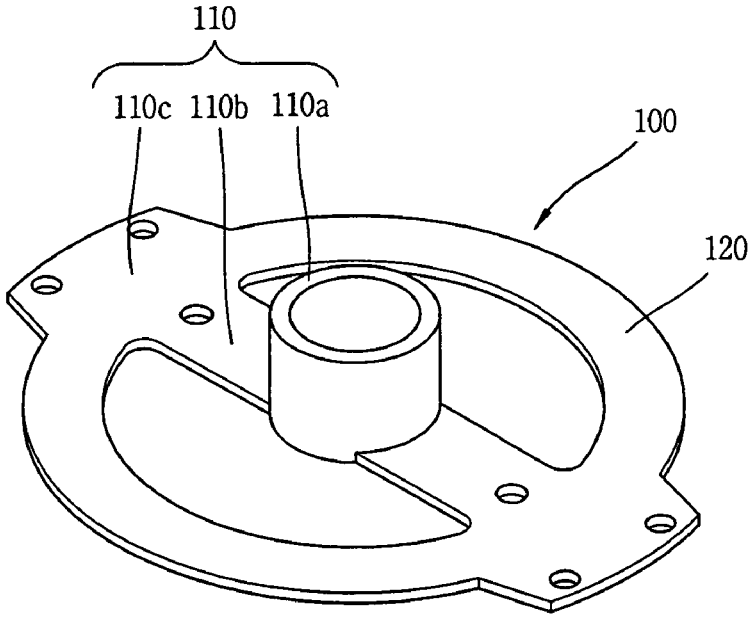
FIG. 13 is a perspective view illustrating a modified example of the bearing housing of FIG. 8.
Figure 14:
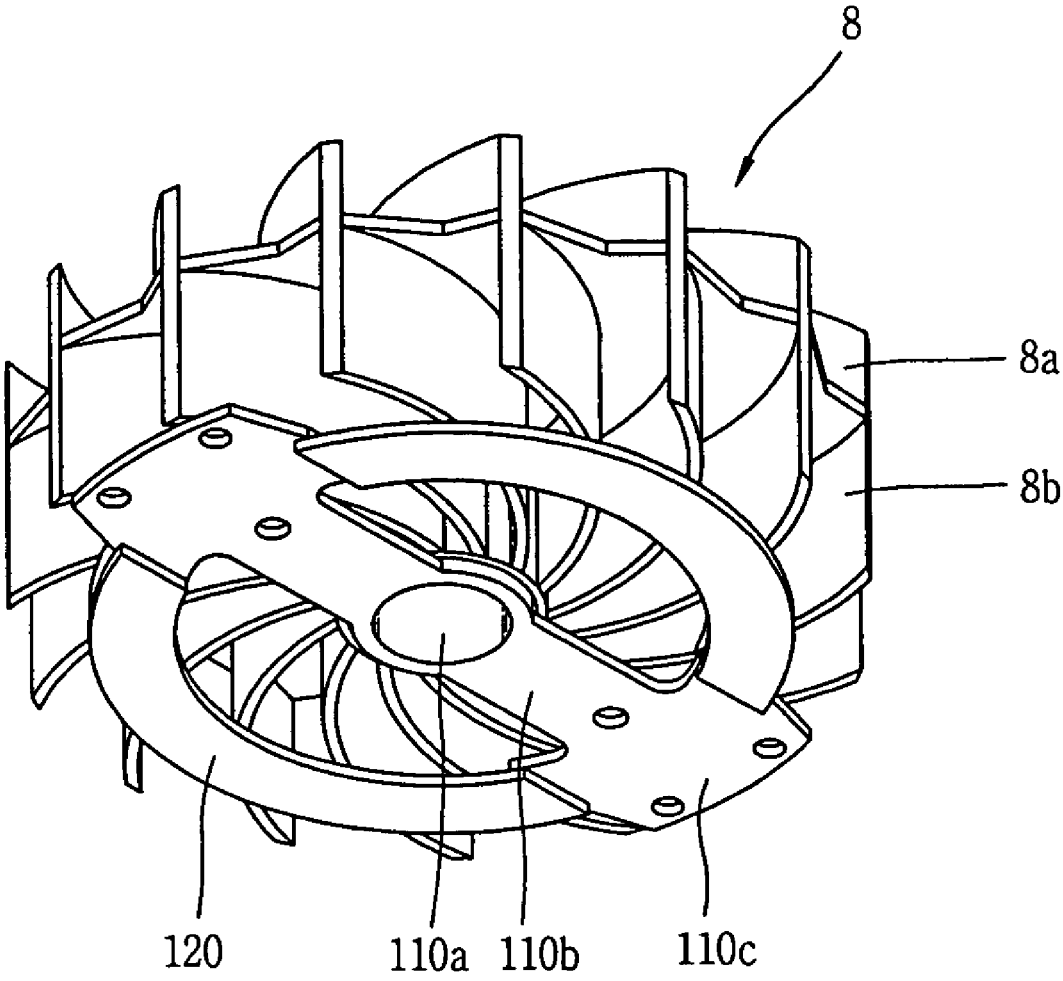
FIG. 14 is a perspective view illustrating a coupling state of the bearing housing of FIG. 8 and a guide vane.

FIG. 6 is a perspective view illustrating a vacuum cleaner having a motor assembly in accordance with the present invention, FIG. 7 is a cross-sectional view illustrating a vacuum cleaner main body of FIG. 6, FIG. 8 is a perspective view illustrating a coupling state of a bearing housing and a rotation shaft of a motor in FIG. 6, FIG. 9 is a perspective view illustrating the bearing housing of FIG. 8, FIG. 10 is a cross-sectional view taken along line X-X of FIG. 9, FIG. 11 is a plane view illustrating the bearing housing of FIG. 8, FIG. 12 is a graph illustrating experiment data showing efficiency by a diameter ratio of the bearing housing of FIG. 11, FIG. 13 is a perspective view illustrating a modified example of the bearing housing of FIG. 8, and FIG. 14 is a perspective view illustrating a coupling state of the bearing housing of FIG. 8 and a guide vane.

Referring to FIG. 6, the vacuum cleaner includes a cleaner main body 30 for generating strong suction force by a built-in motor assembly (not shown), a flexible suction hose 40 connected to the front portion of the cleaner main body 30, a handle 50 formed at the end of the suction hose 40, an extension tube 60 having its one end connected to the handle 50, and a suction nozzle body 70 detachably connected to the other end of the extension tube 60, for sucking the outdoor air and dust along the bottom.

As shown in FIG. 7, a circuit board (not shown) for controlling the operation of the cleaner is mounted in the cleaner main body 30. On the circuit board, various electronic components or elements including a micro-processor chip form a series of circuits for the operation of the cleaner. The motor assembly 20 for generating strong suction force is installed at the front portion of the cleaner main body 30.

FIG. 8 shows part of the motor assembly 20, especially, the coupling state of the bearing housing 100 and the rotation shaft 5 of the motor 4 in accordance with the present invention.

As depicted in FIG. 8, the motor 4 is installed in a motor receiving portion 1*a* formed at a lower portion of a motor housing 1, and the bearing housing 100 is mounted onto the rotation shaft 5 of the motor 4.

The detailed structure of the bearing housing 100 will now be explained with reference to FIG. 9.

As illustrated in FIG. 9, the bearing housing 100 includes a shaft support unit 110 formed in an almost straight shape, and a passage formation unit 120 connected to the shaft support unit 110.

The shaft support unit 110 includes a support protrusion 110*a* formed in a hollow cylinder shape with a shaft hole 110*a*' for housing one end of the rotation shaft 5, and connection plates 110*b* extended from the bottom end of the support protrusion 110*a* to both sides and fixed to the motor housing 1.

The shaft support unit 110 further includes support plates 110*c* extended from the connection plates 10*b*. The support plates 10*c* are extended from the connection plates 110*b* and fixed to the motor housing 1, for supporting the bearing housing 100.

That is, the support plates 110*c* are mounted on a step portion 1*c* between a guide vane receiving portion 1*b* formed at the upper portion of the motor housing 1 and the motor receiving portion 1*a* formed at the lower portion of the motor housing 1.

Preferably, the support plates 110*c* have a larger width than the connection plates 110*b*. When the passage formation unit 120 is connected to the support plates 110*c* of the shaft support unit 110, the connection plates 110*b* must have a smaller width than the support plates 110*c* to increase the area of the passages between the connection plates 110*b* and the passage formation unit 120.

Preferably, two connection plates 110*b* or two support plates 110*c* are extended from the support protrusion 110*a* to both sides in a straight shape, which is not intended to be limiting. That is, more connection plates 110*b* or support plates 110*c* can be formed.

In the case that the connection plates 110*b* or the support plates 110*c* are provided in a multiple number, the passage formation unit 120 serves to connect the adjacent connection plates 110*b* or the adjacent support plates 110*c*.

In accordance with the present invention, the number of the revolutions of the motor 4 for the vacuum cleaner is over about 40,000 RPM. At least two connection plates 110*b* or support plates 110*c* are required to support the rotation shaft 5 rotated at a high speed. In this case, it is advantageous to isolate the plurality of connection plates 110*b* or support plates 110*c* from each other at regular intervals to resist a twisting moment of the shaft hole 110*a*' or the support protrusion 110*a* by rotation of the rotation shaft 5.

In the formation of the connection plates 110*b* and the support plates 110*c*, another reason why the connection plates 110*b* must have a smaller width than the support plates 110*c* is that the support plates 110*c* need spaces for a plurality of fastening holes 110*d* for fixing the bearing housing 100 to the motor housing 1. In addition, although the plurality of fastening holes 110*d* are formed, the rigidity of the support plates 110*c* is not reduced.

The passage formation unit 120 which connects the plurality of connection plates 110*b* or support plates 110*c* is incorporated with the connection plates 110*b* or the support plates 110*c*. That is, the shaft support unit 110 and the passage formation unit 120 are formed as a single body.

The passage formation unit 120 can be integrally formed with the connection plates 110*b* or the support plates 110*c* of the shaft support unit 110 as a single body, or connected to the connection plates 110*b* or the support plates 110*c* as a single body by welding.

The passage formation unit 120 is equivalent in shape to the inner surface of the motor receiving portion 1*a* of the motor housing 1 for easy assembly. Preferably, the passage formation unit 120 is formed in a ring or loop shape with a predetermined area.

As illustrated in FIG. 10, the passage formation unit 120 is incorporated with the shaft support unit 110 with a height difference. That is, the passage formation unit 120 is more downwardly protruded than the shaft support unit 110. Therefore, as shown in FIG. 8, the passage formation unit 120 can be mounted on the inner surface of the motor receiving portion 1*a* of the motor housing 1.

As depicted in FIG. 11, when the inside diameter of the passage formation unit 120 formed in a ring or loop shape is Di and the outside diameter of the passage formation unit 120 is Do, the ratio of the inside diameter Di to the outside diameter Do influences efficiency of the fan-motor.

FIG. 12 is a graph illustrating experiment data showing efficiency of the fan-motor by the ratio of the inside diameter Di to the outside diameter Do of the passage formation unit 120. When the number of the revolutions of the motor 4 is over 40,000 RPM, if the ratio of the inside diameter Di to the outside diameter Do ranges from 0.6 to 0.82, the fan-motor has relatively high efficiency over 40%.

As shown in FIG. 13, the passage formation unit 120 and the shaft support unit 110 can be incorporated without a height difference.

FIG. 14 is a perspective view illustrating a coupling state of the bearing housing 100 and the guide vane 8. Referring to FIG. 14, the passage formation unit 120 contacts outer portions of bottom ends of return vanes 8*b* formed at the lower portion of the guide vane 8, but does not contact the center portions thereof. Accordingly, the center portions of the bottom ends of the return vanes 8*b* are opened to form passages.

That is, still referring to FIGS. 8 and 14, the guide vane 8 is installed at the front portion of the motor 4, and the bearing housing 100 is installed between the motor 4 and the guide vane 8. The passage formation unit 120 blocks the edges or outer portions of the bottom ends of the return vanes 8*b*. Therefore, the passages formed by the return vanes 8*b* and the passage formation unit 120 exist at the center portions of the bottom ends of the return vanes 8*b*.

The area of the passages formed by the bearing housing 100 is determined by the inside diameter Di of the passage formation unit 120. As shown in FIG. 12, when the ratio of the inside diameter Di to the outside diameter Do ranges from 0.6 to 0.82, the fan-motor has high efficiency and high suction force.

In accordance with the present invention, the vacuum cleaner includes the cleaner main body 30, the suction hose 40 connected to the front portion of the cleaner main body 30, the handle 50 formed at the end of the suction hose 40, the extension tube 60 having its one end connected to the handle 50, the suction nozzle body 70 detachably connected to the other end of the extension tube 60, for sucking the outdoor air and dust along the bottom, and the motor assembly 20 installed in the cleaner main body 30, for generating suction force. Here, the motor assembly 20 includes the motor housing 1, the motor 4 installed in the motor housing 1, for supplying suction force, an impeller 7 rotatably installed on the rotation shaft 5 of the motor 4, an impeller cover 6 coupled to the motor housing 1, for covering the impeller 7, the guide vane 8 installed between the motor 4 and the impeller 7, and composed of the plurality of diffuser vanes 8*a* and the plurality of return vanes 8*b* formed on the bottom surfaces of the diffuser vanes 8*a*, and the bearing housing 100 including the passage formation unit 120 for forming the passages by contacting the bottom ends of the return vanes 8*b*, and the shaft support unit 110 for supporting the rotation shaft 5 of the motor 4.

The operation of the present invention will now be described.

In the fan-motor for the vacuum cleaner, when power is applied to the motor 4, rotation force is generated on a rotor 3, for rotating the rotor 3. When the rotor 3 is rotated, the rotation shaft 5 is rotated.

When the rotation shaft 5 is rotated, the impeller 7 coupled to the top end of the rotation shaft 5 is rotated to generate suction force. By the suction force, the air is sucked into the impeller cover 6 through a suction hole 6*a* of the impeller cover 6. The sucked air passes through the impeller 7, and is discharged to the lateral directions of the impeller 7.

After the air passes through the impeller 7, the pressure of the air is raised by the diffuser vanes 8*a* of the guide vane 8. The air with the raised pressure is supplied to the lower side return vanes 8*b* through the space between the inner circumference of the impeller cover 6 and the outer circumference of the guide vane 8.

The air supplied to the return vanes 8*b* is guided not to the outer portions of the return vanes 8*b* blocked by the passage formation unit 120 but to the opened center portions of the return vanes 8*b*, and sent to the motor 4 through the passages formed by the return vanes 8*b* and the passage formation unit 120. Therefore, the motor 4 is cooled and the air is discharged.

As discussed earlier, in accordance with the present invention, the passage formation unit incorporated with the shaft support unit of the bearing housing for supporting the rotation shaft of the motor contacts and blocks the outer portions of the bottom ends of the return vanes, and opens the center portions thereof to form the passages. As a result, the motor assembly and the vacuum cleaner having the same can improve the efficiency and suction force of the fan-motor, by forming the appropriate passages in the fan-motor inclined to the miniaturization and high speed tendency.

Furthermore, the present invention improves applicability to the small-sized vacuum cleaner.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalents of such metes and bounds are therefore intended to be embraced by the appended claims.

What is claimed is:

1. A vacuum cleaner comprising a cleaner main body, a suction hose connected to the front portion of the cleaner main body, a handle formed at the end of the suction hose, an extension tube having its one end connected to the handle, a suction nozzle body detachably connected to the other end of the extension tube, for sucking the air and dust along the bottom, and a motor assembly installed in the cleaner main body, for generating suction force, wherein the motor assembly comprises:

a motor housing;

a motor installed in the motor housing, for supplying suction force;

an impeller rotatably installed on a rotation shaft of the motor;

an impeller cover coupled to the motor housing, for covering the impeller;

a guide vane installed between the motor and the impeller, and composed of a plurality of diffuser vanes and a plurality of return vanes formed on the bottom surfaces of the diffuser vanes; and a bearing housing including a passage formation unit for forming passages by contacting the bottom ends of the return vanes, and a shaft support unit for supporting the rotation shaft of the motor.

2. The vacuum cleaner as claimed in claim 1, wherein the inside diameter of the passage formation unit is 60 to 82.5% of the outside diameter of the passage formation unit.

3. The vacuum cleaner as claimed in claim 1, wherein the shaft support unit is incorporated with the passage formation unit.

* * * * *